US006040748A

United States Patent [19]

Gueissaz

[11] Patent Number: 6,040,748

[45] Date of Patent: Mar. 21, 2000

[54] MAGNETIC MICROSWITCH

[75] Inventor: François Gueissaz, Marin, Switzerland

[73] Assignee: Asulab S.A., Bienne, Switzerland

[21] Appl. No.: 09/058,303

[22] Filed: Apr. 10, 1998

[30] Foreign Application Priority Data

Apr. 21, 1997 [CH] Switzerland ..... 0919/97

[51] Int. Cl.[7] ..... H01H 51/22

[52] U.S. Cl. ..... 335/78; 200/281; 257/421

[58] Field of Search ..... 257/414, 415, 257/735, 780, 421; 335/78, 154; 200/281, 282, 283, 11 H, 11 G, 16 B, 237–238

[56] References Cited

U.S. PATENT DOCUMENTS

| | | | |
|---|---|---|---|
| 4,357,585 | 11/1982 | Wirth . | |
| 4,570,139 | 2/1986 | Kroll . | |
| 5,430,421 | 7/1995 | Bornand . | |
| 5,463,233 | 10/1995 | Norling . | |
| 5,605,614 | 2/1997 | Bornand | 335/154 |
| 5,629,918 | 5/1997 | Ho et al. | 369/112 |
| 5,726,480 | 3/1998 | Pister | 257/415 |

FOREIGN PATENT DOCUMENTS

WO 89/09477 10/1989 WIPO .

*Primary Examiner*—Lincoln Donovan
*Attorney, Agent, or Firm*—Griffin, Butler, Whisenhunt & Szipl, LLP

[57] ABSTRACT

Magnetic microswitch able to be actuated by a magnetic field, including two strips (1, 2) each including a distal portion (5, 5') whose overlap forms an air gap of distance e, at least one of said strips (1) made of magnetic material having one end (3) attached to the substrate via a foot (9), a median portion (4) and a distal portion (5) of length $L_o$, said strip being flexible with respect to the second strip (2). The median portion (4) of the flexible strip (1) is formed with a total cross-section less than that of the distal portion (5) so as to have a lesser bending resistance allowing the strip to have both deflection of an amplitude at least equal to e to make contact under the influence of a magnetic field and sufficient return force towards the open position in the absence of a magnetic field.

16 Claims, 3 Drawing Sheets

MAGNETIC MICROSWITCH

The present invention concerns a strip microswitch whose particular structure assures reliable operation, both for closing an electric circuit by bringing together two strips under the influence of a magnetic field, and for opening said circuit when the magnetic field is removed.

The invention also concerns a method for manufacturing such a microswitch by galvanic growth from a substrate.

More generally, the invention belongs to the well known field of so-called "stem" switches, and in a wider sense, "strip" switches, able to be actuated by an external magnetic field which may be either parallel to the stems or strips, or perpendicular thereto. A parallel field stem switch is generally designated a reed switch. The standard design of such a reed switch consists of a cylindrical glass bulb which is penetrated at each end by a flexible magnetisable stem, the free ends of each stem being able, via their initial movement towards each other, to attract each other under the influence of an external magnetic field to close an electric circuit, and to be brought back to their initial position by the resilient force of the stems or strips, when the magnetic field is removed. Miniaturisation of this standard design is necessarily limited by purely technical factors, so that the smallest reed switches obtained still have a length of the order of 7.5 mm and a diameter of the order of 1.5 mm, while sometimes having dubious mechanical stability.

This standard design has given rise to numerous improvements, from which will be recalled, within the scope of the present invention, on the one hand those which aim to reduce space requirement, for example to allow integration into a micro-electronic assembly such as a timepiece, and on the other hand, those which aim to make their magneto-mechanical performance more reliable and efficient.

As regards solutions for reducing space requirement, reference will advantageously be made to U.S. Pat. No. 5,430,421 which discloses a manufacturing method via galvanic growth from a substrate, allowing batch manufacturing of strip microswitches of very small dimensions, typically devices with strips having a length L of approximately 500 $\mu$m, a thickness a of approximately 100 $\mu$m, for a width b and an air gap e of the order of tens of microns. During use, it has however been observed that certain microswitches from a same batch, i.e. microswitches manufactured in exactly the same conditions, do not meet standards allowing reliable operation to be assured. Construction of a suspended metal structure by galvanic growth allows the geometry and in particular, the thickness of depositions of a ferromagnetic material to be controlled in a sufficiently accurate manner, but does not allow residual stress, which, as is known, is more significant at the beginning of galvanic growth, to be foreseen in a certain manner. Given the very small thickness of the strips, after removal of sacrificial layers, certain microswitches will consequently still be in a closed position, or conversely will have too large an air gap for the strips to be brought into a closed position under the influence of the magnetic field normally applied.

In order to overcome the aforementioned magneto-mechanical drawbacks of microswitches, research has been carried out, for strips which are made of a material having a given modulus of elasticity and which are placed in a given magnetic field, as to which construction parameters it was possible to change in to reduce, or eliminate residual stress while favouring deflection and contact pressure between two strips.

By increasing thickness b of the strip the influence of residual stress is reduced and better positioning of the two strips in relation to each other is obtained, but the rigidity thereof is also thereby increased. In order to have the necessary flexibility for closing, length L of the strip must be increased, which does not meet the invention's object of miniaturisation.

For devices placed in a magnetic field and having a very small air gap e, deflection is approximately proportional to $L^3/br$, L being the length of the strip, b its thickness, and r the length of overlap of the two strips into air gap e. All the other parameters being equal, the contact pressure is approximately proportional to $b^2/r^2$.

Greater deflection can be obtained by increasing L and/or decreasing b. With an increase in L, the global space requirement of the microswitch increases, which does not meet the intended objects of the invention, and which also has the negative effect of increasing dispersion of the magnetic field in the air gap. Decreasing b has the undesirable effect, on the one hand, of considerably reducing the contact pressure, and on the other hand, as previously indicated, of making the strip more sensitive to residual stress.

Only decreasing length of overlap r allows deflection and contact pressure to be simultaneously increased. However, the value of r must remain substantially equal to several times thickness b, otherwise the effects of magnetic field dispersion outweigh the advantage obtained.

It is thus clear from the preceding observations that the knowledge of the man skilled in the art does not provide a satisfactory solution to the magneto-mechanical drawbacks of a microswitch made by galvanic growth.

An object of the present invention is thus to propose a solution wherein, without modifying the global space requirement of the microswitch, original geometry of at least one strip allows the flexibility of said strip to be increased without modifying the maximum force obtained at the end thereof.

The invention thus concerns a magnetic microswitch, made by galvanic growth from a substrate, including two conductive strips of length L and L' and of width a, connected by their respective ends to electric connection means, and each including a distal portion of cross-section a·b and a·b' respectively, whose overlap over a length r determines an air gap of distance e, at least one of said strips being made of magnetic material and consisting of one end attached to the substrate via a foot, a median portion and a distal portion of length $L_o$, said strip being flexible with respect to the distal portion of the second strip between an open position in the absence of a magnetic field and a closed position in which the two strips are in contact with each other under the influence of the magnetic field, said microswitch being characterised in that said median portion of the flexible strip is formed with a total cross-section less than that of the distal portion so as to have a lesser bending resistance allowing the strip to have both deflection of an amplitude at least equal to e to make contact under the influence of a magnetic field and sufficient return force towards the open position in the absence of a magnetic field.

When the magnetic field applied is parallel to the strips, the two strips are made by galvanic growth from a same magnetic material.

By applying a magnetic field to saturation of the median portion it is then possible to increase the contact pressure between the strips by increasing thickness b, b' respectively, of the distal portion, so as to obtain reproducible contacts with low resistance while allowing the strip to have sufficient deflection.

According to a first embodiment, the flexible strip has a constant thickness b from the fixing thereof to the foot to its distal portion, and the median portion which forms the junction between these two ends is formed of one or more isthmuses so that the total transverse cross-section of said median portion is smaller than the cross-section of the distal portion, thus allowing the strip to have greater flexibility without increasing the space requirement thereof.

These isthmuses can delimit one or more openings in the strip. In the event that there is only one isthmus, this latter preferably occupies a central position by delimiting two scallopings on the edges of the strip. The isthmuses may also have a variable cross-section between the end fixed to the foot and the distal portion, for example forming substantially square or rectangular contiguous openings, having surfaces whose value decreases from the point of attachment to the foot.

According to a second embodiment, the strip has no openings, nor scallopings, but its median portion has a smaller thickness than thickness b of the distal portion, forming in some manner a notch in the thickness of the strip, said notch being able to be arranged on one or other of the faces of the strip.

As has already been indicated, the median portion has only a small effect on the magnetic behaviour of the microswitch, in particular when the latter is placed in a magnetic field parallel to the length of the strips. In other words, the active zone is the distal portion of length $L_o$. In this case, it is then advantageous, when the second strip is attached to the substrate, for its length L' to be equal to $L_o$ and its thickness b' to be equal to thickness b of the flexible strip, so as to avoid as far as possible any dispersion of the magnetic field.

When the microswitch is placed in a magnetic field perpendicular to the strips and the second strip is attached to the substrate, it is sufficient for length L' of said second strip to be equal to overlap length r, the material of which it is formed being able to be magnetic or non-magnetic, and the thickness b thereof being able to be greater to thickness b of the flexible strip.

Instead of being directly attached to the substrate, the second strip may also be attached to said substrate via another foot. This second strip will then be flexible and could be structured in accordance with one of the previously described manners, without necessarily having the same structuration as the first strip.

The microswitch according to the invention also allows values b, b' of the thickness of the strips and value e of the air gap to be varied without modifying the global space requirement. An increase in b, b' leads to a decrease in flexibility and correlatively better relative positioning of the two strips allowing air gap value e to be reduced.

Other features and advantages of the invention will appear upon reading the detailed description of embodiment examples, given by way of illustrative and non-limiting example, with reference to the annexed drawings, in which:

FIG. 1 shows a first embodiment example of a microswitch detached from its manufacturing batch. One sees that this latter includes two strips 1, 2 supported by a substrate 10, from which its has been made via galvanic growth as will be explained hereinafter.

Figure 1:
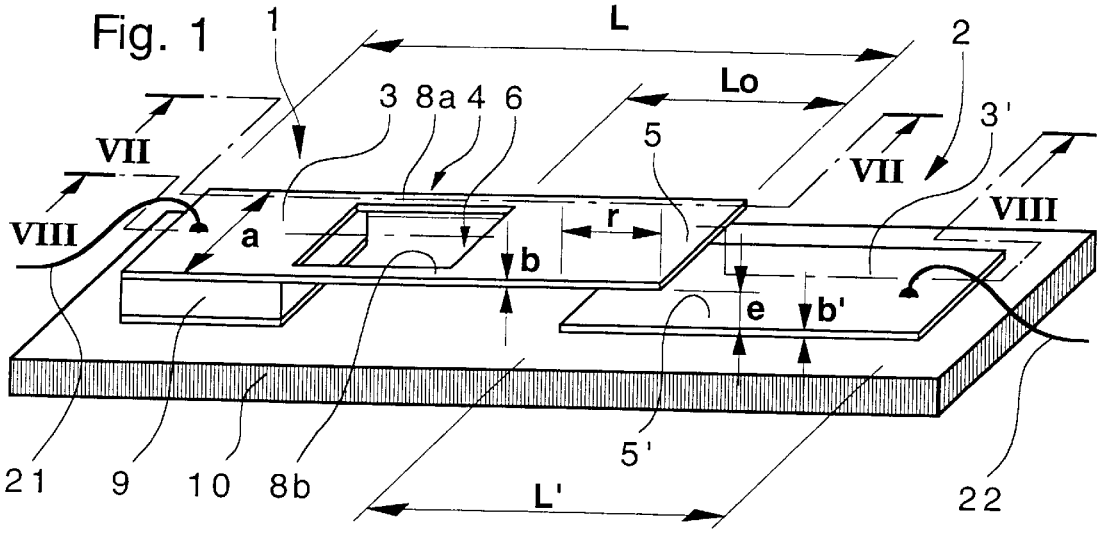
FIG. 1 is a perspective view of a first embodiment example of a microswitch having a single flexible strip, with an indication of all the characteristic lengths.

In this example, the microswitch is arranged to be subjected to a magnetic field parallel to the strips. The material forming the two strips must be ferromagnetic, for example an iron-nickel alloy having low magnetic hysteresis to allow a reproducible opening when the magnetic field is removed.

Each of the two strips includes means for connection to an electric circuit, not shown, represented schematically by conductors 21 and 22, the man skilled in the art being perfectly capable of designing other connection means, in particular when said microswitch is intended to be integrated in a more complex electronic assembly. The two strips have substantially the same width a, comprised between 50 and 150 $\mu$m for example 100 $\mu$m, and a thickness b, b' of the order of 10 $\mu$m. Strip 1, which is attached to substrate 10 via a foot 9, has a total length L, typically comprised between 300 and 900 $\mu$m, for example 500 $\mu$m. This strip 1 includes three zones having substantially the same length and assuming different functions. One end 3 of the strip allows attachment to foot 9, the rest of the strip being suspended above substrate 10. The other end 5, of length $L_o$, designated the "distal portion", assures the magnetic operation. The median portion 4 assures the mechanical operation by allowing the flexibility of strip 1 to be adjusted, i.e. the maximum deflection of distal end 5 in a given magnetic field. For this purpose, median portion 4 includes at its centre a square opening 6 delimiting on the edges of strip 1 two isthmuses 8*a* and 8*b* connecting end 3 attached to foot 9 to distal portion 5. In this median portion, the total cross section is thus less than cross-section a·b of distal portion 5, which gives the strip greater flexibility for a material having a given modulus of elasticity. Second strip 2, attached to the substrate, has a thickness b' and a length L' and has no particular structuration. However, its thickness b' will preferably be substantially equal to thickness b of flexible strip 1. The two strips are positioned in relation to each other in such a way that they overlap over a length r, defining between their facing surfaces an air gap e comprised between 10 and 15 $\mu$m for example 5 $\mu$m. Overlap length r of the two strips will preferably be equal to several times thickness b, b' selected for the strips, so as to reduce the effects of dispersion of the magnetic field.

According to its final use, the microswitch may be encapsulated in air or a controlled atmosphere, for example by means of a plastic housing which is not shown, bonded or welded onto the substrate surface, or by assembly in a suitable case.

Figure 7:
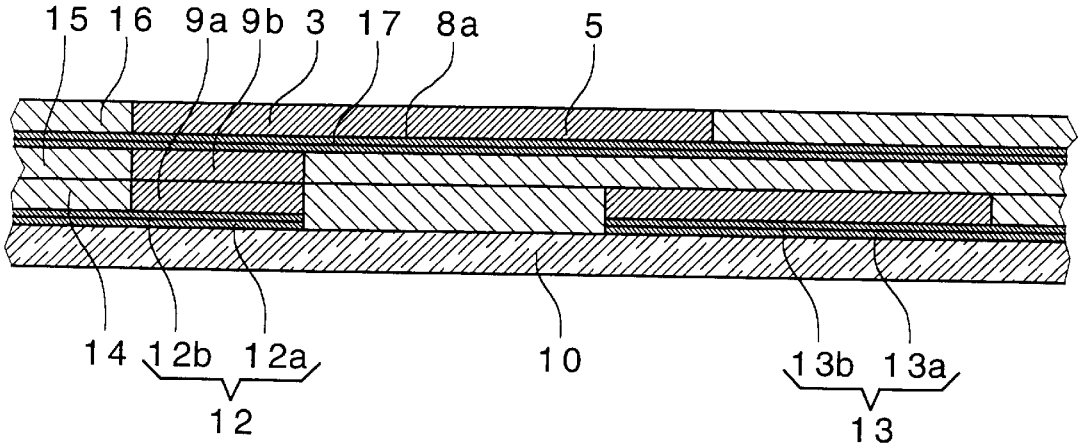
FIG. 7 shows the cross-section along the line VII—VII of FIG. 1, before elimination of sacrificial layers.
Figure 8:
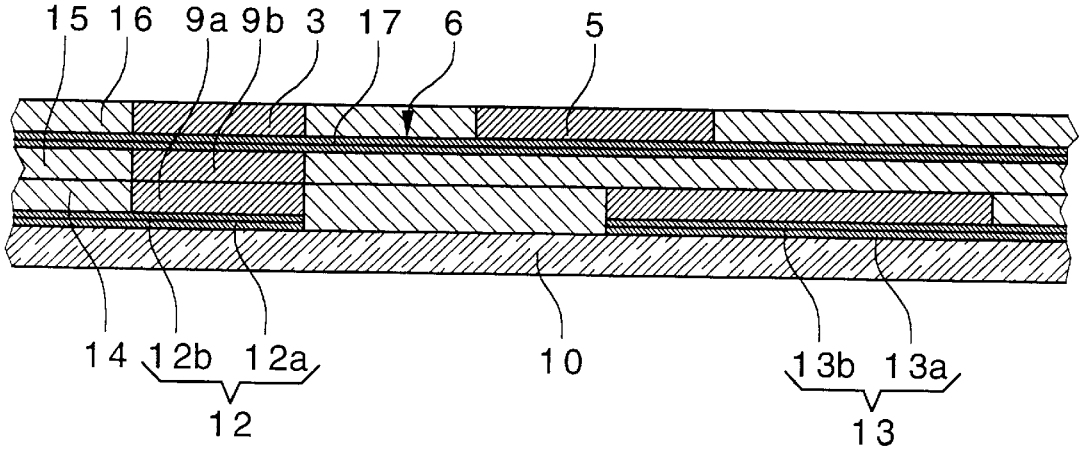
FIG. 8 shows the cross-section along the line VIII—VIII of FIG. 1, before elimination of the sacrificial layers.

With reference to FIGS. 7 and 8, a method for making the microswitch shown in FIG. 1 by galvanic growth from a substrate 10 will now briefly be described. This method consists essentially of adapting at least one step of the method disclosed in U.S. Pat. No. 5,430,421, to which reference may be made for further details. FIG. 7 shows a longitudinal cross-section through an isthmus 8*a* of a single microswitch detached from its manufacturing batch, before elimination of the sacrificial layers. Substrate 10 is in fact merely a portion of a wafer made of an insulating or semi-conductor material or a conductive material covered with an insulating layer allowing a multitude of microswitches to be manufactured in a single batch. Deposition is effected first of a binder layer 12*a* and 13*a*, for example of titanium or chromium, by vapour deposition, then a protective layer 12*b* and 13*b*, for example of gold, so as to form two electrically insulated paths 12 and 13 by etching the surface by known methods. Successive thick photoresist layers 14, 15 and 16 are then deposited, for example by a spin coating technique, each layer of photoresist being patterned by means of a mask (not shown) for arranging openings allowing the galvanic growth to be performed step by step. First layer 14 is patterned with two openings allowing the galvanic growth of a first level 9*a* of foot 9 and strip 2. Second layer 15 is patterned with a single opening allowing the second level 9*b* of foot 9 to be obtained by galvanic growth. Before performing deposition of third layer 16 of photoresist a new double metallisation 17 is effected. This third layer 16 is patterned to leave an opening corresponding to end 3 attached to foot 9, distal portion 5 and isthmuses 8*a* and 8*b* free for galvanic growth, as appears more clearly in FIG. 8. In this example, all the steps of galvanic growth may be performed with the same ferromagnetic material, for example a 20–80 iron-nickel alloy. It is also possible to improve the electric contact of the strips when they are subjected to a magnetic field, by coating their facing surfaces with gold, i.e. after the first galvanic deposition and before the last galvanic deposition. The microstructure thereby obtained is then subjected to an etchant to eliminate, in one or more steps, the photoresist and intermediate metallisation layer 17 and to release the microswitch. As already indicated, all these operations are performed on a batch of microswitches which can be encapsulated before said microswitches are detached therefore by cutting, either individually, or in groups in accordance with a determined arrangement according to their final use.

Figure 2:
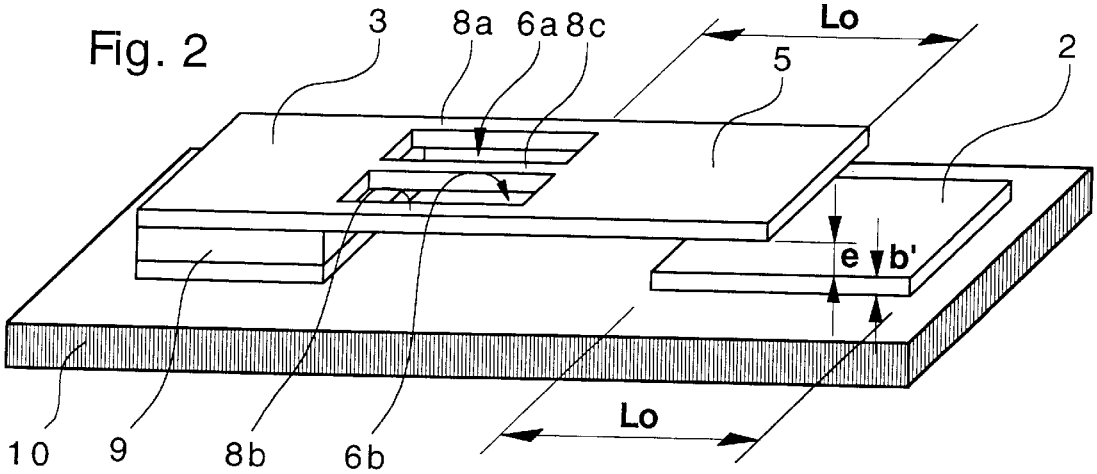
FIGS. 2 to 5 are perspective views of four other embodiment examples wherein only one strip is flexible.

FIG. 2 shows another microswitch example intended to be placed in a magnetic field parallel to the strips and wherein there is again only one flexible strip. Median portion 4 of the flexible strip includes two rectangular openings 6*a* and 6*b*, delimited by three isthmuses 8*a*, 8*b* and 8*c*. As is seen, by comparing FIGS. 1 and 2, second strip 2 attached to the substrate has a length $L'=L_o$, the two strips having the same thickness b=b', of a greater value than that shown in FIG. 1, with a correlative smaller value for air gap e.

Figure 3:
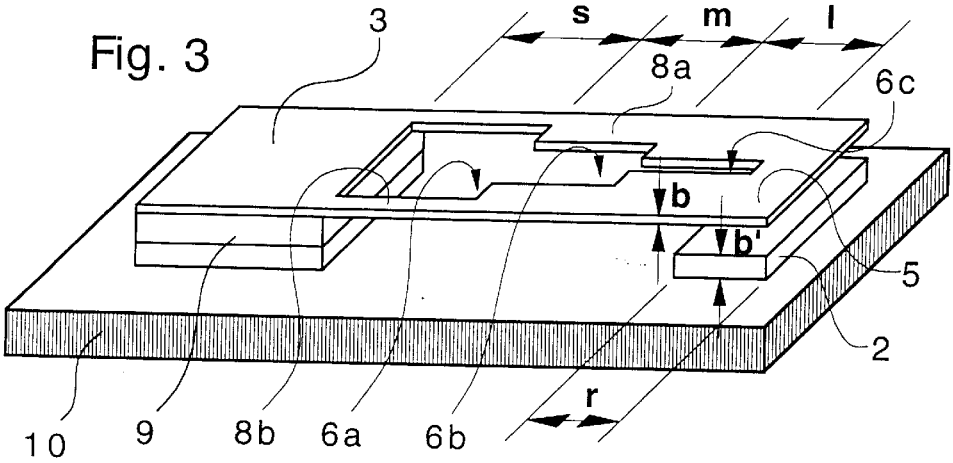

The microswitch shown in FIG. 3 is intended to be placed in a magnetic field perpendicular to the strips. As is seen, second strip 2 attached to the substrate can be reduced to a contact bump having a length L' at least equal to overlap length r of the two strips, and a thickness b' greater than thickness b of the flexible strip. In this example, it is also possible to perform the first growth step, to form the first level of the foot and strip 2 with a non-magnetic material, for example gold. The median portion includes three substantially rectangular and contiguous openings 6*a*, 6*b* and 6*c*, forming a single opening delimited on each edge of the strip by isthmuses 8*a* and 8*b* formed of three zones s, m and l whose width increases from the foot upwards.

Figure 4:
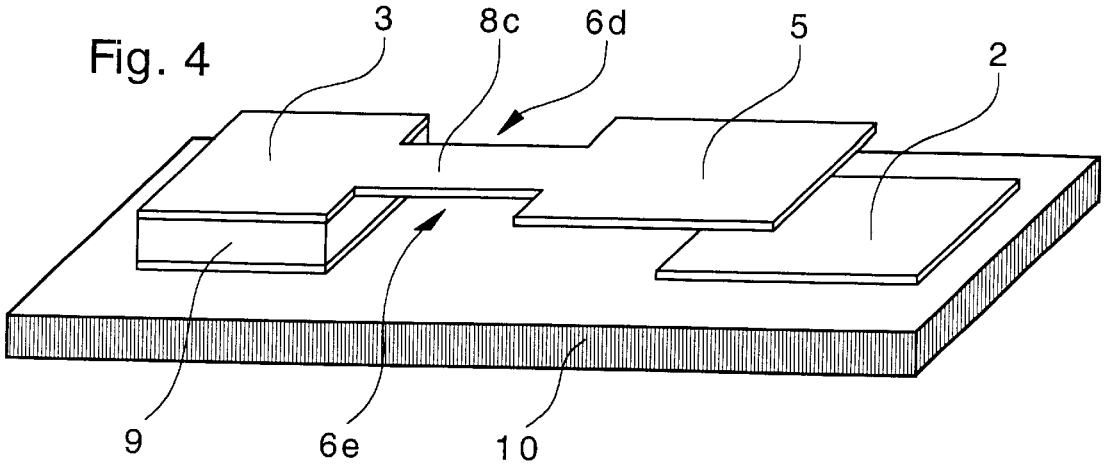

In FIG. 4, the microswitch shown, intended to be placed in a magnetic field parallel to the strips, includes in the median portion of its flexible strip, a single isthmus 8*c* delimiting scallopings 6*d* and 6*e* on the edges of the strip.

Figure 5:
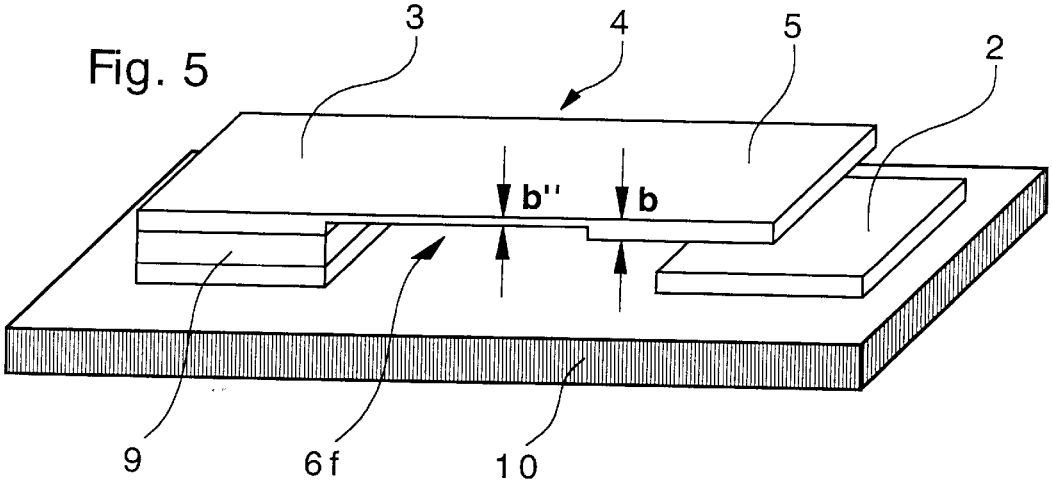

In the microswitch shown in FIG. 5, the increase in flexibility of the mobile strip with respect to strip 2 attached to substrate 10 is obtained by configuring median portion 4 with a thickness b", less than thickness b of distal portion 5. In the example shown, this configuration corresponds to a notch 6*f* open towards the substrate. In order to make this microstructure by galvanic growth, it will of course be necessary to perform an additional step to configure notch 6*f*.

Figure 6:
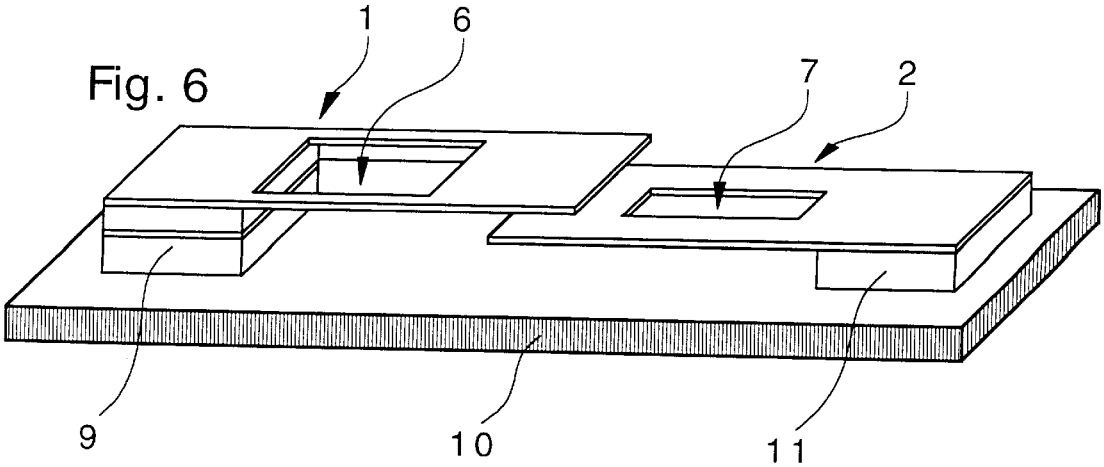
FIG. 6 is a perspective view of a sixth embodiment example wherein the two strips are flexible.

FIG. 6 shows a microswitch intended to be placed in a magnetic field parallel to the strips and wherein the two strips are mobile in relation to each other. A first strip 1 is attached to substrate 10 via a foot 9 and includes in its median portion an opening 6. A second strip 2 is attached to substrate 10 via a foot 11. In the example shown, this second strip also includes in a median portion, a rectangular opening 7. This portion may also have any of the configurations previously described for strip 1, or a total constant cross-section from its end fixed to foot 11 to its distal end. In order to make this microstructure by galvanic growth, it will of course be necessary to perform an additional step to configure foot 11, and to provide an additional metallisation step before configuring and growing by galvanic deposition strip 2 and an additional level of foot 9.

Without departing from the scope of the present invention, the man skilled in the art is in a position to imagine other configurations of the median portion of at least one strip to have greater flexibility and consequently to obtain a microswitch having improved magneto-mechanical features.

What is claimed is:

1. A magnetic microswitch, made in one piece by galvanic growth from a substrate, including two conductive strips having, with respect to one another, overlapping ends and remote ends, connected at their remote ends to electric connection means, and each including a distal portion, whose overlap determines an air gap of distance e, at least one of said strips being made of magnetic material and consisting of one remote end attached to the substrate via a foot, a distal portion, and a median portion formed by at least one isthmus connecting said distal portion to the end fixed to the foot, said strip having a constant thickness and being flexible with respect to the distal portion of the second strip between an open position in the absence of a magnetic field and a closed position in which the two strips are in contact with each other under the influence of the magnetic field, wherein said median portion of the flexible strip is formed with a total cross-section less than the cross-section of the distal portion, thereby allowing the strip to have both deflection of an amplitude at least equal to e to make contact under the influence of a magnetic field and sufficient return force towards the open position in the absence of a magnetic field.

2. A microswitch according to claim 1, wherein the two strips are made of magnetic material.

3. A microswitch according to claim 1, wherein the median portion includes two isthmuses situated on the edges of the strip defining a single rectangular or square opening.

4. A microswitch according to claim 1, wherein the median portion includes more than two isthmuses extending parallel to the length of the strip forming several rectangular or square openings.

5. A microswitch according to claim 3, wherein the two isthmuses situated on the edge of the strip have cross-sections which increase from between the zone of attachment to the foot towards the distal portion thereby forming several contiguous rectangular or square openings.

6. A microswitch according to claim 1, wherein the median portion includes a single central isthmus delimiting scallopings on each of the edges of the strip.

7. A microswitch according to claim 1, wherein the second strip is attached to the substrate, has a constant cross-section and a length equal to the length of the distal portion when the magnetic field applied is parallel to the longitudinal axis of the strips.

8. A microswitch according to claim 1, wherein the second strip is attached to the substrate, has a constant cross-section and a length equal to the length of the overlap of the two strips when the magnetic field applied is perpendicular to the longitudinal axis of the strips.

9. A microswitch according to claim 1, wherein each of the two strips is attached to the substrate via a foot.

10. A microswitch according to claim 1, wherein the two strips have distal portions having the same thickness, when the magnetic field applied is parallel to the longitudinal axis of the strips.

11. A magnetic microswitch, made in one piece by galvanic growth from a substrate, including two conductive strips having, with respect to one another, overlapping ends and remote ends, connected at their remote ends to electric connection means, and each including a distal portion, whose overlap determines an air gap of distance e, at least one of said strips being made of magnetic material and consisting of one remote end attached to the substrate via a foot, a distal portion, and a median portion wherein the thickness of the median portion is less than the thickness of the distal portion, said strip being flexible with respect to the distal portion of the second strip between an open position in the absence of a magnetic field and a closed position in which the two strips are in contact with each other under the influence of the magnetic field, wherein said median portion of the flexible strip is formed with a total cross-section less than the cross-section of the distal portion, thereby allowing the strip to have both deflection of an amplitude at least equal to e to make contact under the influence of a magnetic field and sufficient return force towards the open position in the absence of a magnetic field.

12. A microswitch according to claim 11, wherein the two strips are made of magnetic material.

13. A microswitch according to claim 11, wherein the second strip is attached to the substrate, has a constant cross-section and a length equal to the length of the distal portion when the magnetic field applied is parallel to the longitudinal axis of the strips.

14. A microswitch according to claim 11, wherein the second strip is attached to the substrate, has a constant cross-section and a length equal to the length of the overlap of the two strips when the magnetic field applied is perpendicular to the longitudinal axis of the strips.

15. A microswitch according to claim 11, wherein each of the two strips is attached to the substrate via a foot.

16. A microswitch according to claim 11, wherein the two strips have distal portions having the same thickness, when the magnetic field applied is parallel to the longitudinal axis of the strips.

* * * * *